US011798714B2

(12) United States Patent
Oka

(10) Patent No.: US 11,798,714 B2
(45) Date of Patent: Oct. 24, 2023

(54) CHIP RESISTOR AND METHOD FOR MANUFACTURING CHIP RESISTOR

(71) Applicant: KOA CORPORATION, Ina (JP)

(72) Inventor: Naoto Oka, Ina (JP)

(73) Assignee: KOA CORPORATION, Ina (JP)

( * ) Notice: Subject to any disclaimer, the term of this patent is extended or adjusted under 35 U.S.C. 154(b) by 0 days.

(21) Appl. No.: 17/828,276

(22) Filed: May 31, 2022

(65) Prior Publication Data

US 2022/0399143 A1 Dec. 15, 2022

(30) Foreign Application Priority Data

Jun. 10, 2021 (JP) ..... 2021-097368

(51) Int. Cl.
*H01C 17/00* (2006.01)
*H01C 7/00* (2006.01)
*H01C 1/142* (2006.01)

(52) U.S. Cl.
CPC ..... *H01C 17/006* (2013.01); *H01C 1/142* (2013.01); *H01C 7/003* (2013.01)

(58) Field of Classification Search
CPC ..... H01C 17/006; H01C 1/142; H01C 7/003
See application file for complete search history.

(56) References Cited

U.S. PATENT DOCUMENTS 5,907,274 A * 5/1999 Kimura ..... H01C 7/003 338/308
8,085,551 B2 * 12/2011 Karasawa ..... H01C 17/281 338/205
8,193,899 B2 * 6/2012 Takeuchi ..... H01C 17/006 338/262
9,035,740 B2 * 5/2015 Washizaki ..... H01H 69/022 337/159
2002/0014949 A1 * 2/2002 Tanaka ..... H01C 1/02 338/313
2004/0027234 A1 2/2004 Hashimoto et al.
2020/0066429 A1 2/2020 Imahashi et al.

FOREIGN PATENT DOCUMENTS

JP 2017-076722 A 4/2017
TW 350574 U 1/1999
TW 517251 B 1/2003
WO WO-2019107188 A1 * 6/2019 ..... H01C 1/142

OTHER PUBLICATIONS

WO 2019107188, machine translation. (Year: 2019).*

* cited by examiner

*Primary Examiner* — Kyung S Lee
(74) *Attorney, Agent, or Firm* — Oliff PLC

(57) ABSTRACT

Resistive elements are formed in belt shape in regions sandwiched between secondary division prediction lines set onto a large substrate and extending in a direction orthogonal to primary division prediction lines, a plurality of front electrodes disposed facing each other at predetermined intervals on the resistive elements are formed so as to be across the primary division prediction lines, a glass coat layer covering each of the resistive elements and extending in the direction orthogonal to the secondary division prediction lines is formed, a resin coat layer covering an entire surface of the large substrate from a top of the glass coat layer is formed, and after that, the large substrate is diced along the primary division prediction lines and the secondary division prediction lines to obtain individual chip base bodies.

5 Claims, 4 Drawing Sheets

CHIP RESISTOR AND METHOD FOR MANUFACTURING CHIP RESISTOR

BACKGROUND OF THE INVENTION

(1) Field of the Invention

The present invention relates to a chip resistor surface mounted on a circuit substrate by soldering and a method for manufacturing such chip resistor.

(2) Description of the Related Art

Such the chip resistor includes an insulation substrate in rectangular parallelepiped shape, a pair of front electrodes disposed facing each other at predetermined intervals on the front face of the insulation substrate, a resistive element bridging the paired front electrodes, a protective film having insulation properties and covering the resistive element, a pair of back electrodes disposed facing each other at predetermined intervals on the back face of the insulation substrate, and a pair of end face electrodes formed at both ends of the insulation substrate so as to bridge the front electrodes and the back electrodes, the end face electrodes each having an outer surface covered by an external electrode formed by a plating process.

Typically, when such chip resistor is manufactured, a large number of electrodes, the resistive element, the protective film, and the like are formed together with respect to a large substrate, and then, the large substrate is divided in lattice shape to obtain individual chip base bodies. As such dividing method, a method by which division grooves each having a V-shaped cross section are previously provided in lattice shape on the large substrate and the large substrate is broken along these division grooves is widely known, but with the recent miniaturization of the chip resistor, a method by which the large substrate is cut by dicing in place of providing the division grooves is adopted (for example, see Japanese Unexamined Patent Application Publication No. 2017-76722).

In a method for manufacturing a chip resistor disclosed in Japanese Unexamined Patent Application Publication No. 2017-76722, first, a plurality of front electrodes extending in belt shape so as to be overlapped with primary division prediction lines across secondary division prediction lines are formed on the surface of a large substrate onto which the primary division prediction lines and the secondary division prediction lines extending in lattice shape are set, and then, a plurality of resistive elements are formed in regions sandwiched between the secondary division prediction lines so as to bridge these front electrodes. Next, the surface of the large substrate is laser-scribed along the secondary division prediction lines to form wide scribing traces, thereby dividing the front electrodes extending in belt shape on the secondary division prediction lines. Next, a glass coat layer (undercoat layer) covering each of the resistive elements is formed, and then, a probe is abutted onto a pair of front electrodes connected to both ends of the resistive element to emit a laser beam from the top of the glass coat layer for forming a trimming groove on the resistive element while the resistance value of the resistive element is measured, so that the resistance value of the resistive element is adjusted to be rounded up to a target resistance value range. Next, a resin coat layer (overcoat layer) in belt shape is formed in a region sandwiched between the primary division prediction lines so as to cover the glass coat layer and the resistive element, and the large substrate is cut along the primary division prediction lines and the secondary division prediction lines by dicing blades, so that individual chip base bodies having the same outer shape as the chip resistor are formed.

In the method for manufacturing the chip resistor including these steps, the front electrodes formed in belt shape at the positions overlapped with the primary division prediction lines are divided on the secondary division prediction lines before the resistance value of the resistive element is adjusted, so that the probe is abutted onto the pair of front electrodes connected to the both ends of the resistive element, thereby enabling the trimming groove to be formed on the resistive element while the resistance value of the resistive element is measured.

SUMMARY OF THE INVENTION

In the method for manufacturing the chip resistor described in Japanese Unexamined Patent Application Publication No. 2017-76722, the plurality of front electrodes are formed along the primary division prediction lines so as to extend vertically across the secondary division prediction lines set onto the large substrate, and then, the plurality of resistive elements are formed in the regions sandwiched between the secondary division prediction lines so as to bridge these front electrodes, so that the front electrodes connected to the both ends of each of the resistive elements are required to be divided along the secondary division prediction lines by the laser scribing before the step of adjusting the resistance value of the resistive element. However, such laser scribing performs scanning with the laser beam emitted toward the surface of the large substrate along the secondary division prediction line to form the V-shaped groove, and this is repeated a plurality of times with shifting in the direction orthogonal to the secondary division prediction lines, so that the process for trimming the resistive element including the laser scribing becomes complicated, and when the miniaturization of the chip resistor is promoted, it is difficult to precisely laser-scribe the position of the secondary division prediction line.

The present invention has been made in view of such circumstances of the conventional art, and an object of the present invention is to provide a chip resistor having simple manufacturing steps and suitable for miniaturization.

To achieve the above object, a method for manufacturing a chip resistor according to the present invention includes a resistive element forming step of forming a plurality of resistive elements extending in belt shape across primary division prediction lines in regions sandwiched between secondary division prediction lines on a principal face of a large substrate onto which the primary division prediction lines and the secondary division prediction lines extending in lattice shape are set, an electrode forming step of forming a plurality of electrodes disposed facing each other at predetermined intervals on the resistive elements so as to be across the primary division prediction lines, a glass coat layer forming step of forming a glass coat layer extending in belt shape across the secondary division prediction lines so as to cross the resistive elements exposed from the electrodes, a resistance value adjusting step of adjusting a resistance value of each of the resistive elements by emitting a laser beam from a top of the glass coat layer, a resin coat layer forming step of, after the resistance value adjusting step, forming a resin coat layer so as to cover an entire principal face of the large substrate from the top of the glass coat layer, a dicing step of, after the resin coat layer forming step, forming individual chip base bodies by cutting the large substrate along the primary division prediction lines and the secondary division prediction lines by dicing blades, and an end face electrode forming step of forming an end face electrode in cap shape by coating a conductive paste from a cross-sectional face along the primary division prediction line of each of the chip base bodies to part of a cross-sectional face along the secondary division prediction line of the chip base body.

In the method for manufacturing the chip resistor including these steps, the resistive elements are formed in belt shape in the regions sandwiched between the secondary division prediction lines on the large substrate and extending in the direction orthogonal to the primary division prediction lines, the plurality of electrodes disposed facing each other at predetermined intervals on the resistive elements are formed so as to be across the primary division prediction lines, and then, the glass coat layer covering each of the resistive elements and extending in the direction orthogonal to the secondary division prediction line is formed, so that in the resistance value adjusting step by which the resistance value of the resistive element is trimmed, the complicated laser scribing for dividing the electrodes is not required to be performed, and when the probe is abutted onto the pair of electrodes exposed from the glass coat layer, the trimming groove can be formed while the resistance value of the resistive element is measured. Also, the resistive element is formed in belt shape in the region extending in the direction orthogonal to the primary division prediction line on the large substrate, so that variation in film thickness is unlikely to be caused in the resistive element of each of a large number of obtained chip resistors, thereby enabling the resistive element having a substantially uniform film thickness to be formed.

In the above manufacturing method, each of the electrodes has the largest film thickness on the cross-sectional face along the primary division prediction line of each of the chip base bodies, and is formed so that the film thickness is gradually smaller as a distance from the cross-sectional face increases inward, so that even when the outer shape dimension of the chip resistor is made smaller, the end face electrode in cap shape can be reliably connected to the end faces of the resistive element and the electrode.

Also, in the above manufacturing method, the resin coat layer is made of a transparent or semi-transparent resin material, so that when the large substrate is diced to form each chip base body, the positions of the electrode and the resistive element can be checked through the resin coat layer, and dicing failure in which the resistive element is cut by mistake can thus be prevented.

Also, to achieve the above object, a chip resistor according to the present invention includes an insulation substrate in rectangular parallelepiped shape, a resistive element in belt shape formed along a longitudinal direction on a principal face of the insulation substrate, a pair of electrodes formed at both ends in the longitudinal direction on a surface of the resistive element, a protective layer having insulation properties and covering an entire principal face of the insulation substrate including the resistive element and the both electrodes, and a pair of end face electrodes in cap shape provided at both ends in the longitudinal direction of the insulation substrate and connected to respective end faces of the resistive element, the electrodes, and the protective layer. The protective layer includes a glass coat layer covering the resistive element and a resin coat layer covering the glass coat layer. The glass coat layer is exposed to outside from both end faces in a lateral direction of the insulation substrate.

According to the present invention, the chip resistor having simple manufacturing steps and suitable for miniaturization can be provided.

DETAILED DESCRIPTION OF THE INVENTION

Hereinafter, an embodiment of the invention will be described with reference to the drawings.

Figure 1:
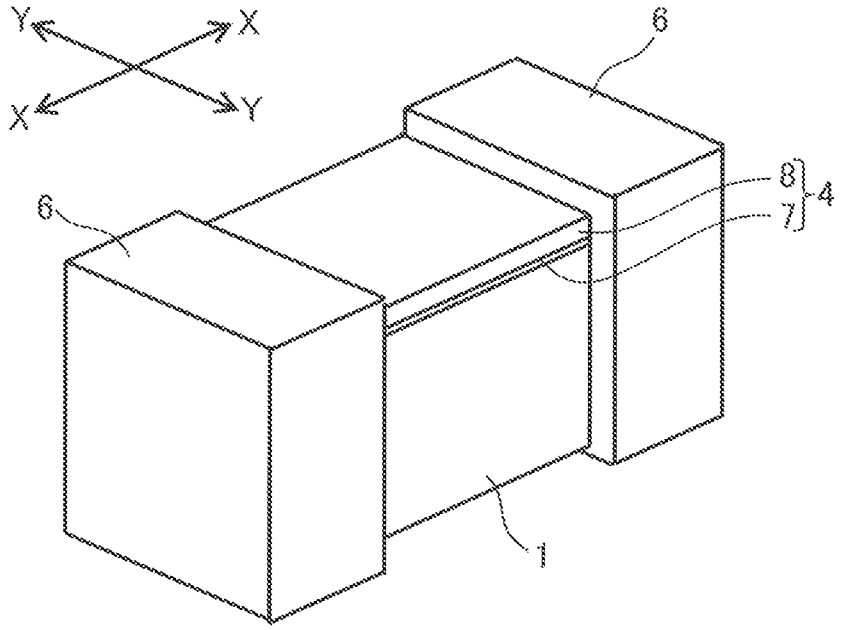
FIG. 1 is a perspective view of a chip resistor according to an embodiment of the present invention.
Figure 2:
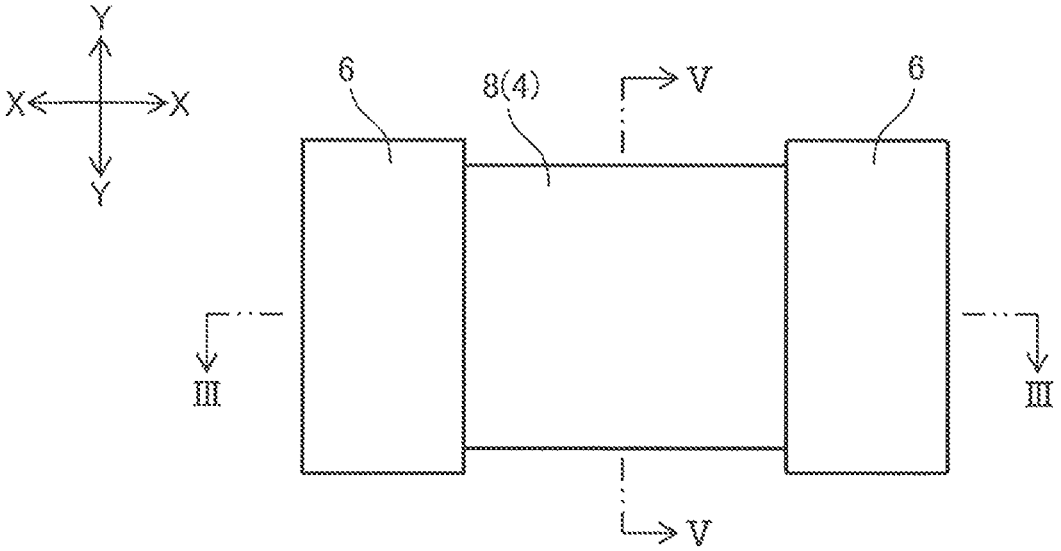
FIG. 2 is a plan view of the chip resistor in FIG. 1 seen from top.
Figure 3:
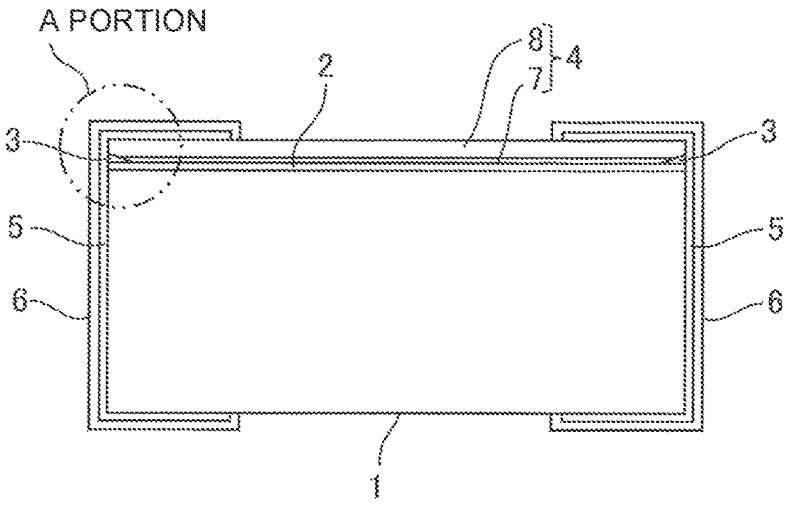
FIG. 3 is a cross-sectional view taken along the line in FIG. 2.
Figure 4:
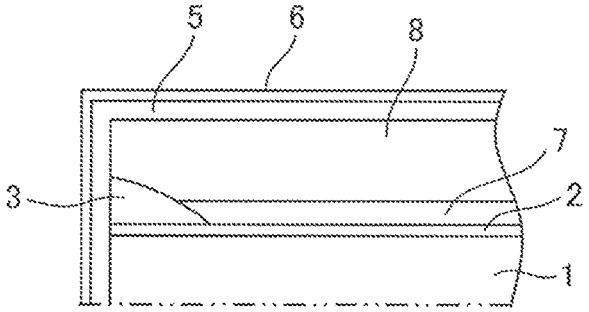
FIG. 4 is a detailed diagram of an A portion in FIG. 3.
Figure 5:
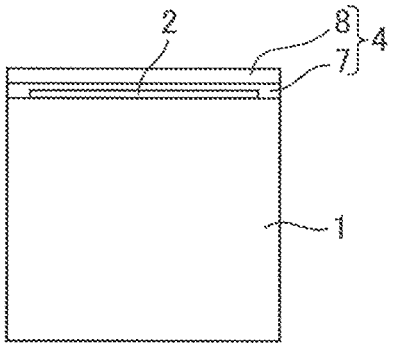
FIG. 5 is a cross-sectional view taken along the V-V line in FIG. 2.

FIG. 1 is a perspective view of a chip resistor according to the embodiment, FIG. 2 is a plan view of the chip resistor in FIG. 1 seen from top, FIG. 3 is a cross-sectional view taken along the line in FIG. 2, FIG. 4 is a detailed diagram of an A portion in FIG. 3, and FIG. 5 is a cross-sectional view taken along the V-V line in FIG. 2.

As illustrated in FIGS. 1 to 5, the chip resistor according to this embodiment mainly includes an insulation substrate 1 in rectangular parallelepiped shape, a resistive element 2 formed in belt shape along a longitudinal direction on the surface of the insulation substrate 1, a pair of front electrodes 3 formed at both ends in the longitudinal direction on the surface of the resistive element 2, a protective layer 4 having insulation properties and covering the entire surface of the insulation substrate 1 including the resistive element 2 and the front electrodes 3, a pair of end face electrodes 5 formed at both ends in the longitudinal direction of the insulation substrate 1 so as to be connected to the respective end faces of the resistive element 2, the front electrodes 3, and the protective layer 4, and a pair of external electrodes 6 adhered to the surfaces of these end face electrodes 5. Note that in the following description, the longitudinal direction of the insulation substrate 1 is an X direction, and a lateral direction of the insulation substrate 1 orthogonal to the X direction is a Y direction.

The insulation substrate 1 is a ceramic substrate having alumina as a main component, and a plurality of insulation substrates 1 are obtained by dicing a large substrate described later along primary division prediction lines and secondary division prediction lines extending in lattice shape.

The resistive element 2 is made in such a manner that a resistance paste such as a ruthenium oxide is screen-printed onto the surface of the insulation substrate 1 and is dried and sintered, and the both ends in the longitudinal direction of the resistive element 2 are exposed from both end faces in the X direction of the insulation substrate 1. Note that although not illustrated, a trimming groove for adjusting a resistance value is formed on the resistive element 2.

The pair of front electrodes 3 is made in such a manner that an Ag paste is screen-printed from the top of the resistive element 2 and is dried and sintered, and these front electrodes 3 are formed at positions overlapped with the both ends in the longitudinal direction of the resistive element 2. As is apparent from FIGS. 3 and 4, each of the front electrodes 3 is a substantially triangular cross-sectional shape having the largest height on the end face side in the X direction of the insulation substrate 1. Note that the front electrodes 3 are exposed from the end faces in the X direction of the insulation substrate 1, and are also exposed from both end faces in the Y direction of the insulation substrate 1.

The protective layer 4 includes a two-layer structure of a glass coat layer 7 covering the resistive element 2 and a resin coat layer 8 covering the glass coat layer 7. The glass coat layer 7 is made in such a manner that a glass paste is screen-printed from the top of the resistive element 2 and is dried and sintered, and the glass coat layer 7 covers the resistive element 2 and is exposed from the both end faces in the Y direction of the insulation substrate 1. Note that the glass coat layer 7 has a film thickness set to be smaller than the largest height dimension of each of the front electrodes 3, the glass coat layer 7 is not exposed from the both ends in the X direction of the insulation substrate 1, and the inclination faces of the front electrodes 3 are exposed from both ends in the X direction of the glass coat layer 7.

The resin coat layer 8 is made in such a manner that an epoxy resin paste is screen-printed from the top of the glass coat layer 7, and is thermally cured, and the resin coat layer 8 is formed of a transparent or semi-transparent resin material and the like. The resin coat layer 8 is formed so as to cover the entire surface of the insulation substrate 1 including the front electrodes 3 and the glass coat layer 7, so that as illustrated in FIG. 1, both ends in the Y direction of the resin coat layer 8 are exposed together with the glass coat layer 7 from both side faces of the insulation substrate 1.

The pair of end face electrodes 5 is made in such a manner that an Ag paste or a Cu paste is dip coated and is thermally cured. These end face electrodes 5 are formed in cap shape so as to cover the upper face of the resin coat layer 8 and the lower face and the both side faces of the insulation substrate 1 from the both end faces in the X direction of the insulation substrate 1. With this, each of the end face electrodes 5 is connected to each of the end faces in the X direction of the resistive element 2, and is connected to each of the front electrodes 3 exposed from three end faces of the insulation substrate 1. Note that the appearance shape of a chip base body before the end face electrodes 5 are formed is a substantially regular quadrangular prism, and the end face electrodes 5 in cap shape are formed at both ends in the longitudinal direction of the chip base body having such shape. That is, the insulation substrate 1 has a rectangular parallelepiped shape in which its thickness dimension (the length in the height direction in FIG. 1) is shorter than its width dimension (the length in the Y direction), but the protective layer 4 having a predetermined thickness (the glass coat layer 7 and the resin coat layer 8) is laminated so as to cover the entire surface of the insulation substrate 1, thereby configuring the chip base body in regular quadrangular prism shape in which its width dimension and its thickness dimension are equal.

Although not illustrated, the pair of end face electrodes 5 is covered by the external electrodes, and these external electrodes are formed by electroplating Ni, Sn, and the like on the surfaces of the end face electrodes 5.

Next, a method for manufacturing the chip resistor configured as above will be described with reference to FIGS. 6A to 6F and 7A to 7F. Note that FIGS. 6A to 6F are plan views illustrating steps of manufacturing the chip resistor, and FIGS. 7A to 7F are cross-sectional views illustrating steps of manufacturing the chip resistor.

First, a large substrate 10A made of ceramic and from which a large number of insulation substrates 1 are obtained is prepared. No primary division grooves and no secondary division grooves are formed on the large substrate 10A, but primary division prediction lines L1 and secondary division prediction lines L2 are set onto the large substrate 10A as dicing positions when the large substrate 10A is divided into each of a large number of chip base bodies in the post-process. That is, when, in FIGS. 6A to 6F, the left-right direction of the large substrate 10A is the X direction and the up-down direction of the large substrate 10A is the Y direction, the primary division prediction lines L1 extending in the Y direction and the secondary division prediction lines L2 extending in the X direction are set in lattice shape onto the large substrate 10A, and each of squares sectioned by these both division prediction lines L1 and L2 becomes one chip forming region.

Figure 6A:
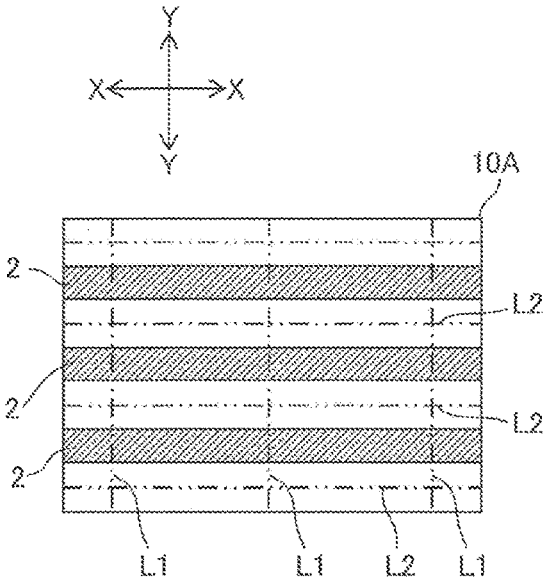
FIGS. 6A to 6F are plan views illustrating steps of manufacturing the chip resistor.
Figure 7A:
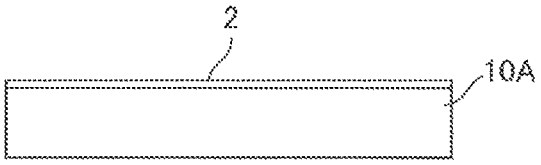
FIGS. 7A to 7F are cross-sectional views illustrating steps of manufacturing the chip resistor.

Then, the resistive element paste such as a ruthenium oxide is screen-printed onto the surface of such large substrate 10A and is dried and sintered, so that as illustrated in FIGS. 6A and 7A, a plurality of resistive elements 2 extending in belt shape in the X direction across the primary division prediction lines L1 are formed in regions sandwiched between the secondary division prediction lines L2 (a resistive element forming step). Note that FIG. 6A illustrates a state where the large substrate 10A is seen in plan view, and FIG. 7A illustrates a state where one chip forming region in FIG. 6A is cross-sectioned along the longitudinal direction of each of the resistive elements 2.

Figure 6D:
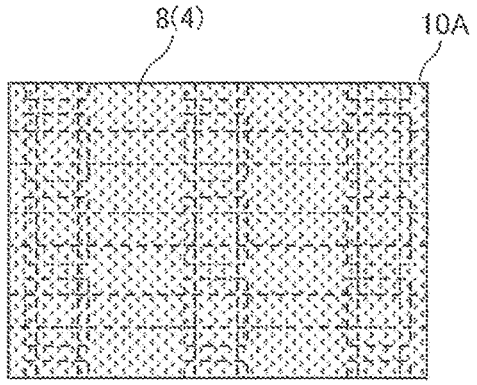
Figure 6B:
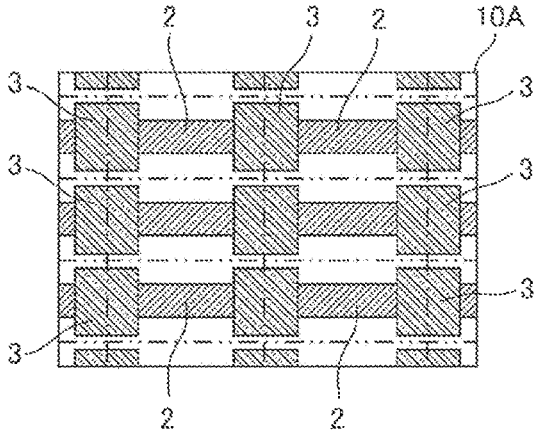
Figure 7D:
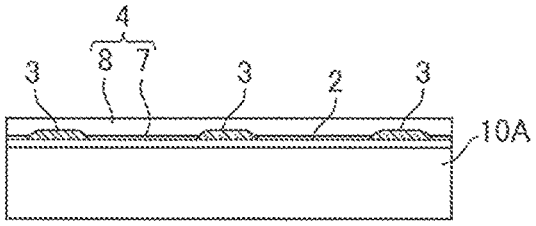
Figure 7B:
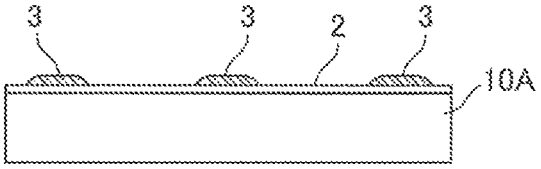

Next, the Ag paste is printed onto the surface of the large substrate 10A and is dried and sintered, so that as illustrated in FIGS. 6B and 7B, a plurality of front electrodes 3 disposed facing each other at predetermined intervals in the X direction are formed at the positions overlapped with the primary division prediction lines L1 on each of the resistive elements 2 (a front electrode forming step). Each of these front electrodes 3 is printed in rectangular shape to have a relatively thick film (4 μm or more), and has a shape in which the film thickness is gradually smaller from its center portion toward the both ends in the X direction by the viscosity of the paste.

Figure 6E:
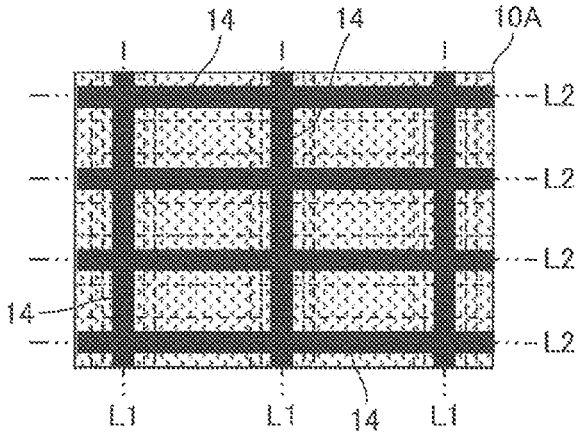
Figure 6C:
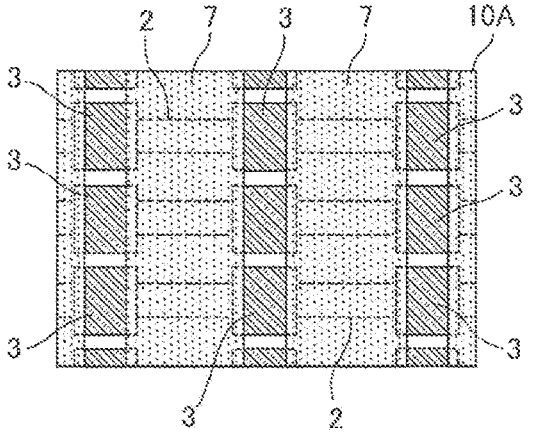
Figure 7E:
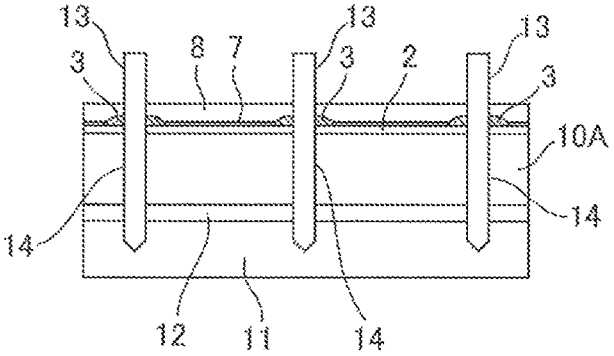
Figure 7C:
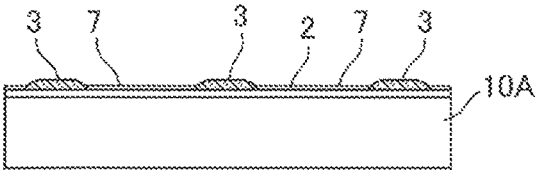

Next, the glass paste is screen-printed and is dried and sintered, so that as illustrated in FIGS. 6C and 7C, the transparent glass coat layer 7 covering the resistive element 2 exposed between the pair of front electrodes 3 is formed (a glass coat layer forming step). The glass coat layer 7 is formed so as to extend in belt shape in the Y direction orthogonal to the longitudinal direction of the resistive element 2 across the secondary division prediction line L2.

Next, a measuring probe (not illustrated) is brought into contact with the pair of front electrodes 3 exposed from the both ends of the glass coat layer 7, and in this state, a laser beam is emitted from the top of the glass coat layer 7 while the resistance value of the resistive element 2 between the both front electrodes 3 is measured, so that the trimming groove, not illustrated, is formed on the resistive element 2 to adjust the resistance value (a resistance value adjusting step).

Next, the epoxy resin paste to which a white pigment is added is screen-printed from the top of the front electrodes 3 and the glass coat layer 7 and is thermally cured, so that as illustrated in FIGS. 6D and 7D, the semi-transparent resin coat layer 8 covering all the chip forming regions of the large substrate 10A including the front electrodes 3 and the glass coat layer 7 is formed (a resin coat layer forming step). The protective layer 4 in a two-layer structure is formed by the glass coat layer 7 and the resin coat layer 8, and the protective layer 4 is a lamination body of the transparent glass coat layer 7 and the semi-transparent resin coat layer 8, so that the positions of the front electrode 3 and the resistive element 2 inside the large substrate 10A can be visually checked through the protective layer 4.

Next, the large substrate 10A is fixed to a fixing substrate 11 made of a hard material such as ceramic through an adhesive 12, and then, the large substrate 10A is cut by dicing blades 13 along the primary division prediction lines L1 and the secondary division prediction lines L2, so that as illustrated in FIGS. 6E and 7E, through slits 14 in lattice shape seen in plan view penetrating through the large substrate 10A to extend to midway of the fixing substrate 11 are formed (a dicing step). In that case, the front electrodes 3 formed so as to be across the primary division prediction lines L1 are divided by the dicing along the primary division prediction lines L1, so that each of the front electrodes 3 printing-formed to have a short dimension has a substantially triangular cross-sectional shape having the largest height on the cross-sectional face along the primary division prediction line L1. Also, both ends of the front electrode 3 extending in the Y direction from the resistive element 2 are cut by the dicing along the secondary division prediction line L2, so that the cross-sectional face of the front electrode 3 is exposed from three faces of the through slit 14.

Then, in such dicing step, the positions of the front electrode 3 and the resistive element 2 inside the large substrate 10A can be visually checked through the protective layer 4 covering the entire surface of the large substrate 10A, so that the dicing positions (the primary division prediction lines L1 and the secondary division prediction lines L2) can be precisely decided. Note that the primary division prediction lines L1 and the secondary division prediction lines L2 are imaginary lines set onto the large substrate 10A, and as described above, no primary division grooves and no secondary division grooves corresponding to the division prediction lines are formed on the large substrate 10A.

Figure 6F:
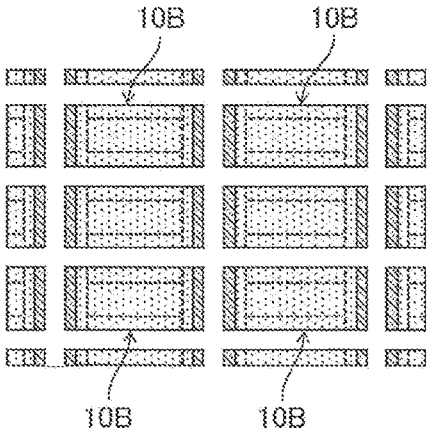
Figure 7F:
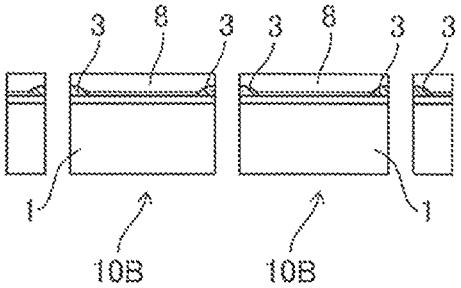

Next, the adhesive 12 is washed to separate the fixing substrate 11 from the large substrate 10A, so that as illustrated in FIGS. 6F and 7F, a large number of chip base bodies 10B having substantially the same outer shape as the chip resistors are obtained.

Although the later steps are not illustrated, the conductive paste such as the Ag paste or the Cu paste is dip coated onto the end face of each of the chip base bodies 10B and is thermally cured, thereby forming the end face electrodes in cap shape extending around from both end faces in the longitudinal direction of the chip base body 10B to the predetermined positions of both end faces in the lateral direction of the chip base body 10B (an end face electrode forming step). In that case, the appearance shape of the chip base body 10B is a substantially regular quadrangular prism, so that the end face electrodes extending around to four faces of the chip base body 10B have a rectangular shape having the same size on all of the surface of the protective layer 4 and the remaining three ceramic faces.

Last, the electroplating of Ni, Sn, and the like is applied to each of the chip base bodies 10B, so that the external electrodes covering the end face electrodes are formed (an external electrode forming step), and the chip resistor as illustrated in FIGS. 1 to 5 is completed.

As described above, in the method for manufacturing the chip resistor according to this embodiment, the resistive elements 2 are formed in belt shape in the regions sandwiched between the secondary division prediction lines L2 set onto the large substrate 10A and extending in the direction orthogonal to the primary division prediction lines L1, the plurality of front electrodes 3 disposed facing each other at predetermined intervals on the resistive elements 2 are formed so as to be across the primary division prediction lines L1, and then, the glass coat layer 7 covering each of the resistive elements 2 and extending in the direction orthogonal to the secondary division prediction lines L2 is formed, so that in the resistance value adjusting step by which the resistance value of the resistive element 2 is trimmed, the complicated laser scribing for dividing the front electrodes 3 is not required to be performed, and the probe is only required to be abutted onto the pair of front electrodes 3 exposed from the glass coat layer 7 to form the trimming groove while the resistance value of the resistive element 2 is measured, so that the manufacturing steps can be prevented from being complicated. Also, the resistive element 2 is formed in belt shape in the region extending in the direction orthogonal to the primary division prediction line L1 on the large substrate 10A, so that variation in film thickness is unlikely to be caused in the resistive element 2 of each of a large number of obtained chip resistors, thereby enabling the resistive element 2 having a substantially uniform film thickness to be formed.

Also, in the method for manufacturing the chip resistor according to this embodiment, each of the front electrodes 3 formed so as to be across the primary division prediction line L1 of the large substrate 10A is divided by the dicing along the primary division prediction line L1, and thus has a substantially triangular cross-sectional shape having the largest height on the cross-sectional face, so that even when the outer shape dimension of the chip resistor is made smaller, the end face electrode 5 in cap shape can be reliably connected to the end faces of the resistive element 2 and the front electrode 3.

Also, in the method for manufacturing the chip resistor according to this embodiment, the protective layer 4 includes a two-layer structure of the transparent glass coat layer 7 and the semi-transparent resin coat layer 8, and when the large substrate 10A is diced to form each of the chip base bodies 10B, the positions of the front electrode 3 and the resistive element 2 inside the large substrate 10A can be checked through the protective layer 4, and dicing failure in which the resistive element 2 is cut by mistake can thus be prevented.

DESCRIPTION OF THE REFERENCE NUMERALS

1 Insulation substrate
2 Resistive element
3 Front electrode
4 Protective layer
5 End face electrode
6 External electrode
7 Glass coat layer
8 Resin coat layer
10A Large substrate
10B Chip base body
11 Fixing substrate
12 Adhesive
13 Dicing blade
14 Through slit
L1 Primary division prediction line
L2 Secondary division prediction line

What is claimed is:

1. A method for manufacturing a chip resistor comprising:

a resistive element forming step of forming a plurality of resistive elements, each resistive element extending in belt shape across a plurality of primary division prediction lines in a region sandwiched between secondary division prediction lines on a principal face of a large substrate onto which the primary division prediction lines and the secondary division prediction lines extending in lattice shape are set;

an electrode forming step of forming a plurality of electrodes disposed facing each other at predetermined intervals on the resistive elements so as to be across the primary division prediction lines;

a glass coat layer forming step of forming a glass coat layer extending in belt shape across the secondary division prediction lines so as to cross the resistive elements exposed from the electrodes;

a resistance value adjusting step of adjusting a resistance value of each of the resistive elements by emitting a laser beam from a top of the glass coat layer;

a resin coat layer forming step of, after the resistance value adjusting step, forming a resin coat layer so as to cover an entire principal face of the large substrate from the top of the glass coat layer;

a dicing step of, after the resin coat layer forming step, forming individual chip base bodies by cutting the large substrate along the primary division prediction lines and the secondary division prediction lines by dicing blades; and an end face electrode forming step of forming an end face electrode in cap shape by coating a conductive paste from a cross-sectional face along the primary division prediction line of each of the chip base bodies to part of a cross-sectional face along the secondary division prediction line of the chip base body.

2. The method according to claim 1, wherein each of the electrodes has the largest film thickness on the cross-sectional face along the primary division prediction line of each of the chip base bodies, and is formed so that the film thickness is gradually smaller as a distance from the cross-sectional face increases inward.

3. The method according to claim 1, wherein the resin coat layer is made of a transparent or semi-transparent resin material.

4. A chip resistor comprising:

an insulation substrate in rectangular parallelepiped shape;

a resistive element in belt shape formed along a longitudinal direction on a principal face of the insulation substrate;

a pair of electrodes formed at both ends in the longitudinal direction on a surface of the resistive element;

a protective layer having insulation properties and covering an entire principal face of the insulation substrate including the resistive element and both of the pair of electrodes; and a pair of end face electrodes in cap shape provided at both ends in the longitudinal direction of the insulation substrate and connected to respective end faces of the resistive element, the pair of electrodes, and the protective layer;

wherein the protective layer includes a glass coat layer covering the resistive element and a resin coat layer covering the glass coat layer, wherein the glass coat layer is exposed to outside from both end faces in a lateral direction of the insulation substrate, and wherein the cap shape of the pair of end face electrodes extends from a surface of the protective layer on an opposite side from the insulation substrate to a surface of the insulation substrate opposite the principal face and the pair of end face electrodes are in contact with respective end faces of the insulation substrate.

5. The method according to claim 2, wherein the resin coat layer is made of a transparent or semi-transparent resin material.

* * * * *